US006788005B2

(12) United States Patent
Chu et al.

(10) Patent No.: US 6,788,005 B2
(45) Date of Patent: Sep. 7, 2004

(54) INVERTER AND LAMP IGNITION SYSTEM USING THE SAME

(75) Inventors: Yi-Shan Chu, Hsinchu (TW); Cheng-Chia Hsu, Hsinchu (TW)

(73) Assignee: Ambit Microsystems Corp., Hsinchu (TW)

( * ) Notice: Subject to any disclaimer, the term of this patent is extended or adjusted under 35 U.S.C. 154(b) by 0 days.

(21) Appl. No.: 10/076,428

(22) Filed: Feb. 19, 2002

(65) Prior Publication Data

US 2002/0125836 A1 Sep. 12, 2002

(30) Foreign Application Priority Data

Mar. 7, 2001 (CN) ..... 90105250 A

(51) Int. Cl.[7] ..... H05B 37/00

(52) U.S. Cl. ..... 315/219; 315/209 CD; 363/80; 363/127

(58) Field of Search ..... 315/241 R, 219, 315/276, 224, 291, 307, 209 CD, 209 R, 225, 308, 244, 247; 363/80, 89, 90, 97, 98, 127, 21.01, 56

(56) References Cited

U.S. PATENT DOCUMENTS 5,150,013 A * 9/1992 Bobel ..... 315/209 R
5,493,181 A * 2/1996 Shackle et al. ..... 315/241 R
5,510,681 A * 4/1996 Nilssen ..... 315/219
6,069,807 A * 5/2000 Boylan et al. ..... 363/97
6,091,616 A * 7/2000 Jacobs et al. ..... 363/127
6,295,213 B1 * 9/2001 Smith ..... 363/21.01

* cited by examiner

*Primary Examiner*—Wilson Lee
(74) *Attorney, Agent, or Firm*—Michael D. Bednarek; Shaw Pittman LLP

(57) ABSTRACT

An inverter for igniting a discharge lamp comprises a transformer, a first switch transistor, a second switch transistor, a first snubber capacitor, a second snubber capacitor, a reset capacitor, and a control circuit. One of the source/drain of the first switch transistor is electrically coupled to the primary side of the transformer. One of the source/drain of the second switch transistor is electrically coupled to the primary side of the transformer. The first snubber capacitor is electrically coupled between the source and the drain of the first switch transistor. The second snubber capacitor is electrically coupled between the source and the drain of the second switch transistor. The reset capacitor is electrically coupled between the other of the source/drain of the first switch transistor and the other of the source/drain of the second switch transistor. The control circuit controls the first switch transistor and the second switch transistor so that the two transistors will not conduct at the same time.

19 Claims, 2 Drawing Sheets

Vin = 5V , D = 50 %

INVERTER AND LAMP IGNITION SYSTEM USING THE SAME

BACKGROUND OF THE INVENTION

1. Field of the Invention

The present invention relates to an inverter in a lamp ignition device, particularly to a mono-stage high-efficiency inverter for the backlight module of a liquid crystal display (LCD).

2. Description of the Related Art

Discharge lamps, such as cold cathode fluorescent lamps (CCFLs), are usually used as the backlight source of LCD panels. Such a lamp has terminal voltage characteristics that vary with the immediate status and the frequency of the stimulus (AC signal) applied to the lamp. The CCFL will not conduct current until it is struck or ignited. When the lamp conducts current, the applied terminal voltage is less than the strike voltage. For example, the terminal voltage must be greater than or equal to 1500 V to strike the lamp. Once an electrical arc is strike in the CCFL, the terminal voltage falls to a lower run voltage, which is approximately one third of the strike voltage, and the current input range is relatively wide. For example, the run voltage of a CCFL may be 500 V with a current range of 500 mA to 6 mA while the strike voltage thereof is 1500 V. The CCFL is usually driven by an AC signal with a frequency ranging from 30 KHz to 100 KHz.

Discharge lamps exhibit negative resistance characteristics, so the operating voltage decreases when the consumed power increases. The circuit for supplying power to the lamp, such as an inverter, requires a controllable alternating current power supply and a feedback loop capable of accurately monitoring the current in the lamp so as to maintain the stability of the circuit and to have load-regulation ability.

When designing inverters for LCD backlight system of notebook or desktop computers, efficiency, cost and size are some of the most critical factors. A conventional inverter for LCD backlight system, such as the inverter numbered CXA-K05L-FS sold by TDK Corporation of Tokyo, Japan, comprise a buck converter and a current-fed self-oscillating push-pull inverter (also called a Royer inverter). The efficiency of such combination of a buck converter and a Royer inverter is limited by the two power conversion stages. Particularly, the magnetizing inductance of the transformer in the Royer DC/AC converter serving as the resonant inductance causes additional power loss.

Currently, the efficiency of an inverter having a structure of two power conversion stages, the buck stage and the Royer stage, is about 70–80%. Especially in the case of a low input voltage, a higher coil ratio of the transformer is required, so that the loss increases and the entire efficiency decreases. Such transformer structure uses a central tap, and thus is difficult to be miniaturized and has a higher manufacturing cost. Besides, only one set of the coils operates in each of the half-cycle of the transformer, and the utility rate is accordingly low. Moreover, the output voltage waves of such inverter have higher harmonic compositions, which cause a lower illuminating efficiency, a shortened lifespan of a lamp, and a greater electromagnetic interference. In summary, such inverter has the disadvantages of higher manufacturing cost, lower efficiency, and excessive harmonic waves.

SUMMARY OF THE INVENTION

In view of the above, it is an object of the present invention to provide an inverter for lamp ignition device, which is constructed by a single power conversion stage.

It is another object of the present invention to provide an inverter for lamp ignition device, in which the transformer has a simple structure without the provision of a central tap.

It is a further object of the present invention to provide an inverter for lamp ignition device, which operates at a duty cycle of approximately D=0.5 and is dimmable by burst mode control. Current asymmetry is thus avoided.

It is still a further object of the present invention to provide a lamp ignition system, which outputs to the lamp voltage waves with less harmonic compositions. Therefore, higher illuminating efficiency, longer lifespan of the lamp, and smaller electromagnetic interference are achieved.

Accordingly, the invention discloses an inverter for the ignition of a discharge lamp. The inverter according to the invention comprises a transformer, a first switch transistor, a second switch transistor, a reset capacitor and a control circuit. One of the source/drain of the first switch transistor is electrically coupled to the primary side of the transformer. One of the source/drain of the second switch transistor is electrically coupled to the primary side of the transformer. The reset capacitor is electrically coupled between the other of the source/drain of the first switch transistor and the other of the source/drain of the second switch transistor. The control circuit controls the first switch transistor and the second switch transistor not to conduct current at the same time.

The control circuit further renders both the first and the second switch transistors non-conducting during the interval between the conducting of the first switch transistor and the conducting of the second switch transistor. The control circuit further controls the current value at the secondary side of the transformer according to a burst mode control signal.

The control circuit comprises a driving circuit which utilizes the voltage across the reset capacitor as driving power for generating two switch control signals respectively output to the first switch transistor and the second switch transistor so as to reduce the conducting resistance thereof.

Moreover, the present invention discloses a lamp ignition system comprising a discharge lamp and an inverter. The inverter comprises a transformer, a first switch transistor, a second switch transistor, a reset capacitor, a first snubber capacitor, a second snubber capacitor and a control circuit. The secondary side of the transformer is electrically coupled to the discharge lamp. One of the source/drain of the first switch transistor is electrically coupled to the primary side of the transformer. One of the source/drain of the second switch transistor is electrically coupled to the primary side of the transformer. The reset capacitor is electrically coupled between the other of the source/drain of the first switch transistor and the other of the source/drain of the second switch transistor. The first snubber capacitor is electrically coupled between the source and the drain of the first switch transistor. The second snubber capacitor is electrically coupled between the source and the drain of the second switch transistor. The control circuit generates two switch control signals in response to a voltage feedback signal representing the current value at the secondary side of said transformer and respectively outputs them to the gate of the first switch transistor and the gate of the second switch transistor to thereby cause the first switch transistor and the second switch transistor not to conduct current at the same time.

The control circuit comprises an error amplifier and a pair of comparators. The error amplifier senses the voltage feedback signal representing the current value of the discharge lamp and a reference voltage to perform error amplification. The pair of comparators generate two switch control signals according to the comparison result of the output of the error amplifier and a reference triangular wave.

BRIEF DESCRIPTION OF DRAWINGS

The above is a brief description of some deficiencies in the prior art and advantages of the present invention. Other features, advantages and embodiments of the invention will be apparent to those skilled in the art from the following description, accompanying drawings, wherein.

DETAILED DESCRIPTION OF THE INVENTION

Figure 1:
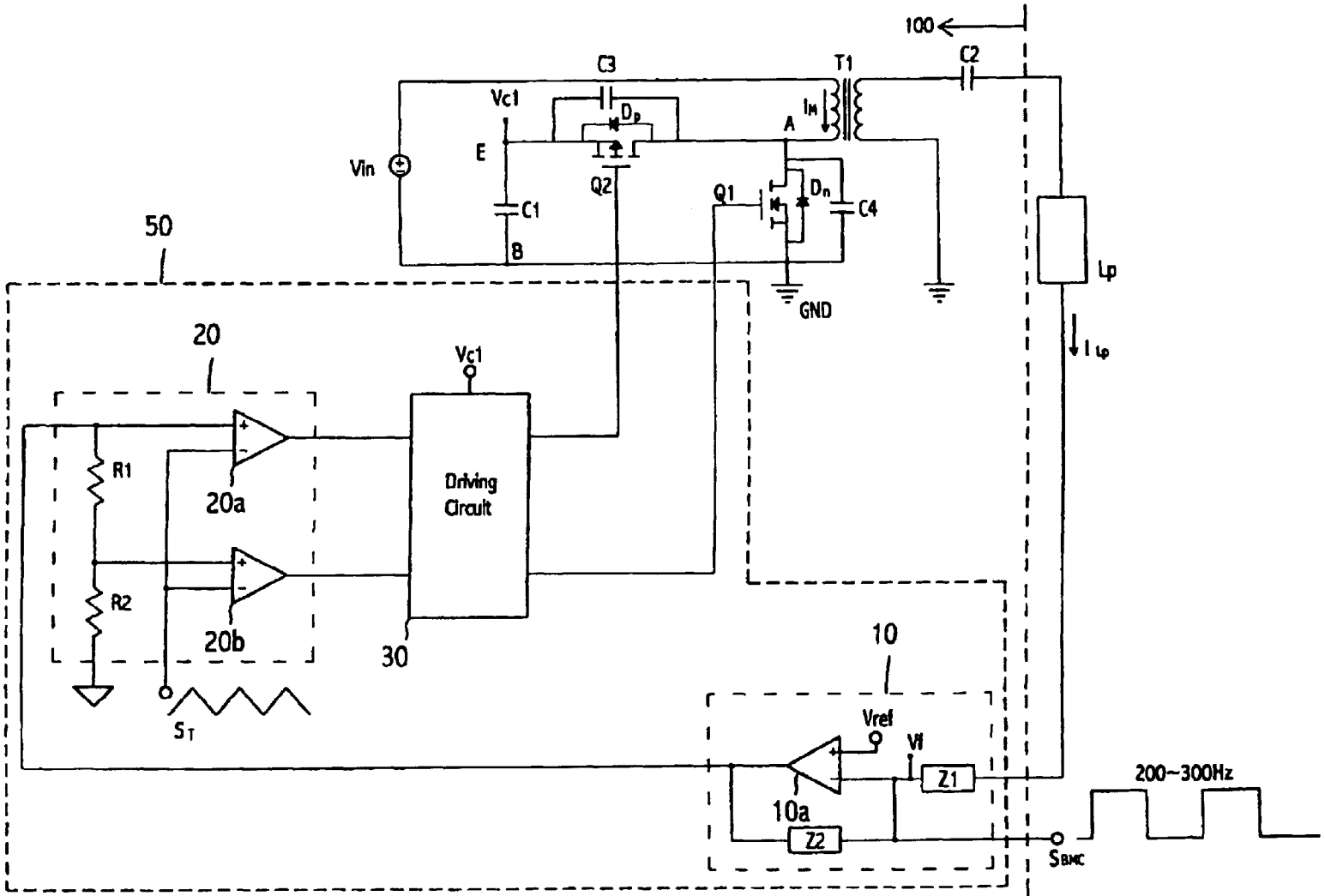
FIG. 1 shows the combination of an inverter and a discharge lamp of the preferred embodiment according to the invention.

FIG. 1 shows the combination of an inverter and a discharge lamp of the preferred embodiment according to the invention. An inverter 100 and a lamp Lp constitute a lamp ignition system. The inverter 100 according to the first preferred embodiment of the invention comprises a transformer T1, a switch transistor Q1, a switch transistor Q2, and a reset capacitor C1. One of the source/drain of the switch transistor Q1 is electrically coupled to the primary side of the transformer T1 at node A while the other of the source/drain thereof is electrically coupled to the reset capacitor C1 at node B. One of the source/drain of the switch transistor Q2 is electrically coupled to the primary side of the transformer T1 at node A while the other of the source/drain thereof is electrically coupled to the reset capacitor C1 at node E. The discharge lamp Lp is electrically coupled to the secondary side of the transformer T1. A DC power source outputs DC voltage Vin to the inverter 100. In the preferred embodiment, the switch transistor Q1 is preferably an NMOS transistor, and the switch transistor Q2 a PMOS transistor; however, this is only exemplary, not limiting.

Figure 2:
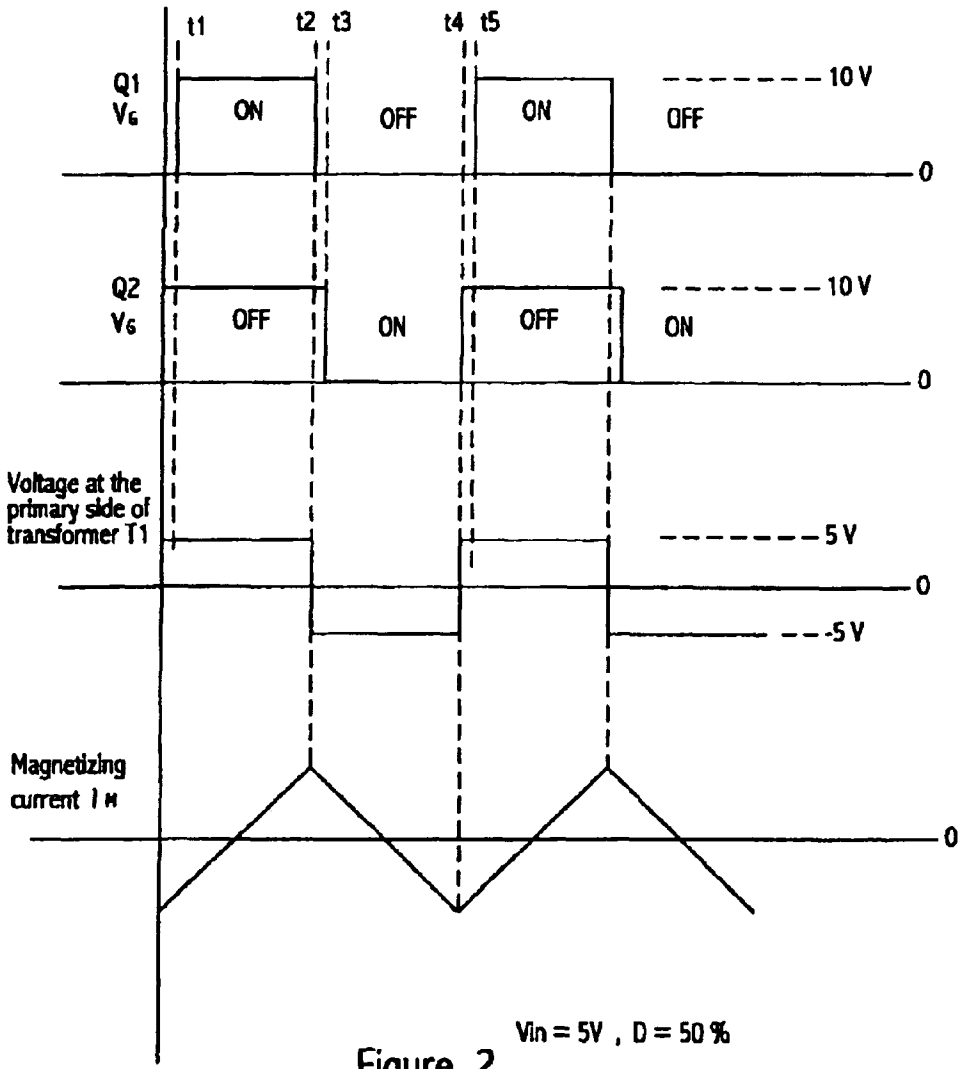
FIG. 2 shows a timing diagram of the operation in the inverter of the preferred embodiment.

For simplicity, the following analysis is performed under Vin=5V and D=0.5, wherein D denotes the duty cycle of the switch transistor Q1 or Q2. When a DC voltage Vin is provided to the inverter 100, voltage Vin charges the capacitor C1 through the body diode Dp of the switch transistor Q2 located at the primary side of the transformer T1. When the voltage across the capacitor C1 reaches a certain value, switch transistors Q1 and Q2 begin to switch and the entire circuit works. Please refer to FIGS. 1 and 2. FIG. 2 shows a timing diagram of the operation in the inverter of the preferred embodiment.

During the time interval of t1 to t2, the switch transistor Q1 is ON, while the switch transistor Q2 is OFF. The DC voltage Vin charges the magnetizing inductor of the transformer T1, which linearly increases its magnetizing current $I_M$. At this time, the voltage across the primary winding of the transformer T1 is Vin=5V, wherein part of the power is stored in the magnetizing inductor and part of the power is transferred to the secondary winding of the transformer T1.

During the time interval of t2 to t3, both the switch transistors Q1 and Q2 are OFF. Since the current at the primary side of the transformer T1 should be continuous, the body diode Dp of the switch transistor Q2 is conducting.

During the time interval of t3 to t4, the switch transistor Q1 is OFF, while the switch transistor Q2 is ON. The voltage Vc1 across the capacitor C1 (capacitor C1 must be large enough to provide a stable DC voltage Vc1) resets the magnetic flux of the transformer T1, which linear decreases the magnetizing current $I_M$. At this time, the voltage across the primary side of the transformer T1 is (Vc1−Vin)=−5V.

During the time interval of t4 to t5, both the switch transistors Q1 and Q2 are OFF. Since the current at the primary side of the transformer T1 should be continuous, the body diode Dn of the switch transistor Q1 is conducting.

According to the above analysis, the body diodes Dn and Dp start to conduct current before the switch transistors Q1 and Q2 turn on, and therefore the switch transistors, when turning on, have the characteristic of zero voltage switching (ZVS).

The turning-off of the switch transistors is hard-switching. Therefore, snubber capacitors C3 and C4 are parallelly-connected between the drain and the source of the switch transistors Q1 and Q2 respectively to delay the rising time of the source-drain voltage Vds, to reduce the cross-over area of the drain current (Id) and the source-drain voltage (Vds), and to lower the power loss resulting from the turning-off of the switches. Accordingly, when the switch is in the ON state, the average voltage value of the magnetizing inductor of the transformer T1 is zero, and thus Vc1=Vin/(1−D) is derived. For example, when Vin=5V and D=0.5, Vc1=2Vin=10V. The voltage Vc1 across the capacitor C1 is appropriately used as the driving power of the switch to thereby obtain a smaller conducting resistance (Rdson) and lower conducting loss. Since a smaller conducting resistance (Rdson) is obtained, a considerably good result can be achieved by simply using a PMOS as the switch transistor Q2. The complicated isolation driving circuit is not required now that we do not use NMOS as the switch transistor Q2.

According to the preferred embodiment, the control circuit 50 of the inverter 100 can be constituted by an error amplifier 10 and a pair of comparators 20, wherein the dead time can be varied by adjusting the ratio of resistors R1 and R2 to avoid that the switch transistors Q1 and Q2 conduct current at the same time.

The error amplifier 10 comprises an amplifier 10*a*, an impedance network Z1 and an impedance network Z2. The impedance network Z1 transforms the current $I_{Lp}$ through the discharge lamp Lp at the secondary side of the transformer T1 to a voltage feedback signal Vf in proportion to the current $I_{Lp}$. The amplifier 10*a* senses the voltage feedback signal Vf, which represents the lamp current at the secondary side of the transformer T1, and a reference voltage Vref to perform error amplification. The impedance network Z2 is provided for balancing the resistances at the output terminal and input terminal of the amplifier 10*a*.

According to the comparison result of the output of the error amplifier 10 and a triangular wave $S_T$, the pair of comparators 20 generate control signals for controlling switch transistors Q1 and Q2. The pair of comparators 20 comprise voltage-dividing resistors R1+R2 and comparators 20*a* and 20*b*. The voltage-dividing resistors R1+R2 are electrically coupled to the output terminal of the error amplifier 10 to provide two different voltage values for respectively output to the comparators 20*a* and 20*b*. The comparators 20*a* and 20*b* respectively compare a triangular wave $S_T$ to the two different voltage values from the voltage-dividing resistors and generate two switch control signals for controlling the switch transistors Q1 and Q2.

Moreover, the present invention may further utilize a driving circuit 30 for enhancing the driving power of the switch control signals. The voltage Vc1 across the capacitor C1 can be used to power the driving circuit 30. Therefore, switch transistors Q1 and Q2, when turning on, may have a smaller conducting resistance (Rdson) to thereby reduce the conducting loss.

By using the leakage inductance at the secondary side of the transformer T1 and the leakage current of the lamp as a filter and the capacitor C2 as a decoupling capacitor, the AC square waves at the primary side of the transformer T1 are filtered into sinusoidal waves for supplying to the lamp Lp. Since the output voltage is approximate to sinusoidal wave, which has less harmonic compositions, the electromagnetic interference is reduced to thereby increase the lighting efficiency and prolong the lift of the lamp.

The circuit of the present invention may operate around D=0.5 and utilize burst mode signals $S_{BMC}$(200 Hz~300 Hz) for dimming control. Therefore, no asymmetry of the lamp current occurs.

The circuitry of the present invention is a mono-stage conversion configuration, and thus an efficiency of over 85% can be obtained. In addition, the control circuitry has the advantages of simplicity and low-cost.

The above description provides a full and complete description of the preferred embodiments of the present invention. Various modifications, alternate construction, and equivalents may be made by those skilled in the art without changing the scope or spirit of the invention. Accordingly, the above description and illustrations should not be construed as limiting the scope of the invention which is defined by the following claims.

What is claimed is:

1. An inverter, comprising:

a transformer;

a first switch transistor having a first current-conducting terminal and a second current-conducting terminal with the first current-conducting terminal thereof being electrically coupled to the primary side of said transformer;

a second switch transistor having a first current-conducting terminal and a second current-conducting terminal with the first current-conducting terminal thereof being electrically coupled to the primary side of said transformer;

a reset capacitor electrically coupled between the second current-conducting terminal of said first switch transistor and the second current-conducting terminal of said second switch transistor;

a control circuit for generating two switch control signals in response to a voltage feedback signal representing the current value at the secondary side of said transformer and respectively outputting to the gate of said first switch transistor and the gate of said second switch transistor to thereby cause said first switch transistor and said second switch transistor not to conduct current at the same time; and a decoupling capacitor electrically coupled to the secondary side of said transformer.

2. The inverter of claim 1, further comprising:

a first snubber capacitor electrically coupled between the first current-conducting terminal and the second current-conducting terminal of said first switch transistor; and a second snubber capacitor electrically coupled between the first current-conducting terminal and the second current-conducting terminal of said second switch transistor.

3. The inverter of claim 1, wherein said control circuit comprises a driving circuit which utilizes the voltage across said reset capacitor as driving power for generating said two switch control signals.

4. The inverter of claim 1, wherein said control circuit comprises:

an error amplifier, for sensing said voltage feedback signal representing the current value at the secondary side of said transformer and a reference voltage to perform an error amplification, and a pair of comparators for generating said two switch control signals according to the comparison result of the output of said error amplifier and a reference triangular wave.

5. The inverter for claim 4, wherein said control circuit further comprises a driving circuit for enhancing the driving power of said two switch control signals.

6. The inverter of claim 4, wherein said control circuit further controls the current value at the secondary side of said transformer according to a burst mode control signal received by said error amplifier.

7. The inverter of claim 4, wherein said pair of comparators comprise:

a voltage-driving resistor electrically coupled to the output terminal of said error amplifier for providing two outputs with different voltages;

a first comparator electrically coupled to one of the two outputs of said voltage-driving resistor for generating one of said two switch control signals; and a second comparator electrically coupled to the other of the two outputs of said voltage-driving resistor for generating the other of said two switch control signals.

8. The inverter of claim 1, wherein said control circuit further controls the current value at the secondary side of said transformer according to a burst mode control signal.

9. The inverter of claim 1, wherein said control circuit further renders both said first and said second switch transistors non-conducting during the interval between the conducting of said first switch transistor and the conducting of said second switch transistor.

10. A lamp ignition system, comprising:

a discharge lamp; and an inverter;

wherein said inverter comprises:

a transformer with the secondary side thereof electrically coupled to said discharge lamp;

a first switch transistor having a first current-conducting terminal and a second current-conducting terminal with the first current-conducting terminal thereof being electrically coupled to the primary side of said transformer;

a second switch transistor having a first current-conducting terminal and a second current-conducting terminal with the first current-conducting terminal thereof being electrically coupled to the primary side of said transformer;

a reset capacitor electrically coupled between the second current-conducting terminal of said first switch transistor and the second current-conducting terminal of said second switch transistor; and a control circuit for generating two switch control signals in response to a voltage feedback signal representing the current value at the secondary side of said transformer and respectively outputting to the gate of said first switch transistor and the gate of said second switch transistor to thereby cause said first switch transistor and said second switch transistor not to conduct current at the same time, wherein said inverter further comprises a decoupling capacitor electrically coupled between the secondary side of said transformer and said discharge lamp.

11. The lamp ignition system of claim 10, wherein said inverter further comprises:

a first snubber capacitor electrically coupled between the first current-conducting terminal and the second current-conducting terminal of said first switch transistor; and a second snubber capacitor electrically coupled between the first current-conducting terminal and the second current-conducting terminal of said second switch transistor.

12. The lamp ignition system of claim 10, wherein said control circuit comprises a driving circuit which utilizes the voltage across said reset capacitor as driving power for generating said two switch control signals.

13. The lamp ignition system of claim 10, wherein said control circuit comprises:

an error amplifier, for sensing said voltage feedback signal representing the current value at the secondary side of said transformer and a reference voltage to perform an error amplification, and a pair of comparators for generating said two switch control signals according to the comparison result of the output of said error amplifier and a reference triangular wave.

14. The lamp ignition system of claim 13, wherein said control circuit further comprises a driving circuit for enhancing the driving power of said two switch control signals.

15. The lamp ignition system of claim 13, wherein said control circuit further controls the current value at the secondary side of said transformer according to a burst mode control signal received by said error amplifier.

16. The lamp ignition system of claim 10, wherein said pair of comparators comprise:

a voltage-driving resistor electrically coupled to the output terminal of said error amplifier for providing two outputs with different voltages;

a first comparator electrically coupled to one of the two outputs of said voltage-driving resistor for generating one of said two switch control signals; and a second comparator electrically coupled to the other of the two outputs of said voltage-driving resistor for generating the other of said two switch control signals.

17. An inverter, comprising:

a transformer;

a first switch transistor having a first current-conducting terminal and a second current-conducting terminal with the first current-conducting terminal thereof being electrically coupled to the primary side of said transformer;

a second switch transistor having a first current-conducting terminal and a second current-conducting terminal with the first current-conducting terminal thereof being electrically coupled to the primary side of said transformer;

a reset capacitor electrically coupled between the second current-conducting terminal of said first switch transistor and the second current-conducting terminal of said second switch transistor; and a control circuit for controlling said first switch transistor and said second switch transistor not to conduct current at the same time, wherein said control circuit comprises a driving circuit which utilizes the voltage across said reset capacitor as driving power for generating two switch control signals respectively outputted to said first switch transistor and said second switch transistor so as to reduce the conducting resistance thereof.

18. The inverter of claim 17, wherein said control circuit further renders both said first and said second switch transistors non-conducting during the interval between the conducting of said first switch transistor so as to reduce the conducting resistance thereof.

19. The inverter of claim 17, further comprising:

a first snubber capacitor electrically coupled between the first current-conducting terminal and the second current-conducting terminal of said first switch transistor; and a second snubber capacitor electrically coupled between the first current-conducting terminal and the second current-conducting terminal of said second switch transistor.

* * * * *